US005784819A

United States Patent [19]

Roper

[11] Patent Number: 5,784,819

[45] Date of Patent: Jul. 28, 1998

[54] TRIGGER SAFETY LOCK

[76] Inventor: Richard Blair Roper, 717 White Oak Cir., Flowood, Miss. 39208

[21] Appl. No.: 810,643

[22] Filed: Mar. 3, 1997

[51] Int. Cl.[6] ..... F41A 17/00

[52] U.S. Cl. ..... 42/70.11; 42/70.06; 42/70.07

[58] Field of Search ..... 42/70.11, 70.06, 42/70.07

[56] References Cited

U.S. PATENT DOCUMENTS

| | | | |
|---|---|---|---|
| 667,051 | 1/1901 | Ackerman | 42/70.11 |
| 2,487,971 | 11/1949 | Jenkinson | 42/70 |
| 2,914,877 | 12/1959 | Willenbacher | 42/70 |
| 4,031,649 | 6/1977 | Brock | 42/70 F |
| 4,070,783 | 1/1978 | Edwards | 42/69 R |
| 4,302,898 | 12/1981 | LaRue | 42/1 LP |
| 4,962,605 | 10/1990 | Aigner | 42/69.01 |

*Primary Examiner*—Charles T. Jordan
*Assistant Examiner*—Meena Chelliah

[57] ABSTRACT

A trigger safety lock system is provided which provides ease in operation by authorized users by utilizing a sequence of buttons for combinational locking of the trigger or firing mechanism without the need for attachment of external accessories. The buttons act within a key way structure to permit or block movement of the trigger or firing mechanism. Such trigger devices can be used in various apparatus, such as firearms, tools and machines.

2 Claims, 2 Drawing Sheets

TRIGGER SAFETY LOCK

BACKGROUND OF THE INVENTION

A number of locking mechanism have been devised to prevent the unauthorized use of trigger-activated devices, such as firearms. These concerns arise relating to use of such devices, especially firearms, by unauthorized persons, including children and persons who tamper with such devices. In other situations danger arises when persons with illicit purposes take without right weapons from police officers or private persons. While weapons typically have a safety device, such devices are deficient as impediments to prevent such unauthorized uses. Locks have been created which attach to the trigger of a firearm to prevent access to the trigger, and thus render the weapon inoperable. Representative patents include BROOKS, U.S. Pat. No. 5,090,148; BAKO, U.S. Pat. No. 4,499,681; and CERVANTES, U.S. Pat. No. 4,084,341. Such locks are cumbersome and difficult to remove from the weapon or to readily operate so as to permit use by authorized users. Such can reduce the effectiveness in emergency situations. For example, the police officer in immediate need of the weapon, or the private citizen who must use the weapon for self-defense, could suffer if significant delays were involved in making the weapon operational. While the firearm safety device in BROOKS attempted to alleviate such cumbersomeness by integrating the lock into the weapon systems, the disclosed lock involved a complicated multi-wheel system which additionally required being able to visually see the dials utilized upon the weapon safety mechanism in order to effect making the weapon operational. Additionally, such safety mechanism involves numerous mechanical elements, which complexity lends to maintenance or operational problems.

It would be desirous to provide a trigger safety mechanism which can lock a device, such as a firearm or tool, against unauthorized use, yet be readily activated by an authorized user. It would also be desirable if the locking mechanism would require no external accessories, such that the authorized user could readily activate, or deactivate, the device at any time. It would also be desirable to provide a safety lock which can be activated or deactivated without viewing the lock. It would also be desirable to provide a safety lock which is not bulky, and which would not hamper operation of the tool or devices when installed.

SUMMARY OF THE INVENTION

It is an object of the present invention to provide a trigger device safety mechanism which will render the device inoperable to unauthorized users.

It is another object of the present invention to provide a trigger device safety mechanism which can be quickly activated or deactivated by authorized users.

It is an still another object of the present invention to provide a trigger device safety mechanism which would not require external accessories.

It is an object of the present invention to provide a trigger device safety mechanism which can be activated or deactivated without viewing the mechanism.

It is an object of the present invention to provide a trigger device safety mechanism which is easily installed.

It is an object of the present invention to provide a trigger device safety mechanism which is easily manipulated to lock and unlock.

These and other objects are provided by a trigger safety mechanism which utilizes a set of buttons, which when all are in the proper positions, provide a key way to a structure which is connected to the trigger or firing mechanism. When the buttons are in the right position or sequence The trigger can be activated. If one or more of the buttons is not in the proper position, the trigger will be locked in place by the safety buttons or buttons filling or blocking the engagement portion of the trigger device.

BRIEF DESCRIPTION OF THE DRAWINGS

There are shown in the drawings embodiments of the present invention, which embodiment is a firearm, and it being understood that the invention is not limited to firearms or the particular firearm shown, not to the precise arrangements and instrumentality shown.

DESCRIPTION OF EMBODIMENTS

One embodiment of the present invention is a firearm safety lock for a weapon having a trigger, which lock comprises an engagement portion moveable to a position in which the engagement portion can be operatively locked to prevent movement of the trigger or firing mechanism, and two or more lock members operatively optionally moveable to a locked configuration which locks movement of the engagement portion or to an unlocked configuration which permits movement of the engagement portion. The engagement portion is either monolithically connected to or operatively linked to the trigger or firing mechanism such that the engagement portion translationally moves with movement of the trigger or firing mechanism. The lock members are preferably set in the device in a location which is forward of the trigger. In other words, the lock members are set in the device on the opposite side of the trigger from the handle, if any, of the device, or the portion of the devices which is grasped or otherwise held for operation.

The lock members are preferably sliding buttons that can be set to provide one or more combinations of "on" and "off" settings. These lock members are of any shape functional, but are preferably pegs which are notched perpendicular to the long axis of the buttons. Such notching is configured such that notches which are in the engagement portion of the safety lock will align so as to provide a key way which permits the engagement portion to move when force is applied to move the trigger. By movement of the buttons, the key way configuration changes into one in which the engagement portion is no longer moveable.

Figure 1:
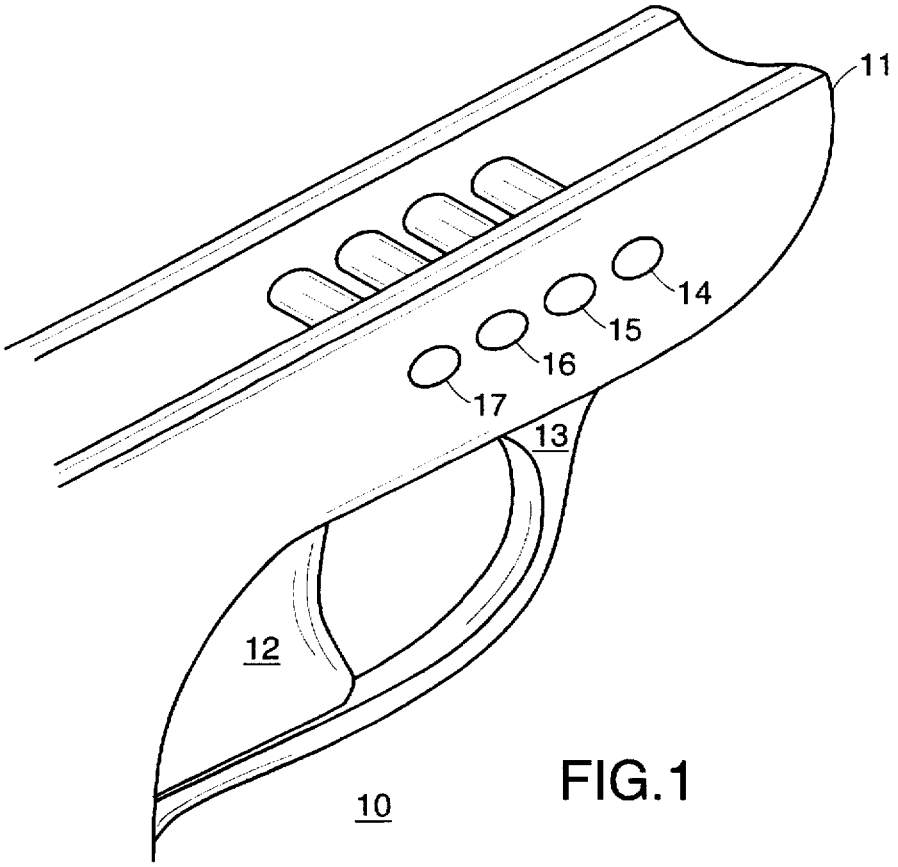
FIG. 1 depicts a handgun frame embodying a portion of the present invention.

Referring now the figures, FIG. 1 depicts a handgun frame 10 having receiver 11, trigger 12, trigger guard 13, and a plurality of slot tubes being slot tube 14, slot tube 15, slot tube 16, and slot tube 17. The structure of trigger 12 is that of a sliding trigger. An example of such a sliding trigger is that in a Colt MK IV/Series '70 Government Model pistol. Other types of sliding triggers can also be used. Other embodiments, however, are not limited to a sliding trigger model but can be others, such as a double action trigger.

Figure 2:
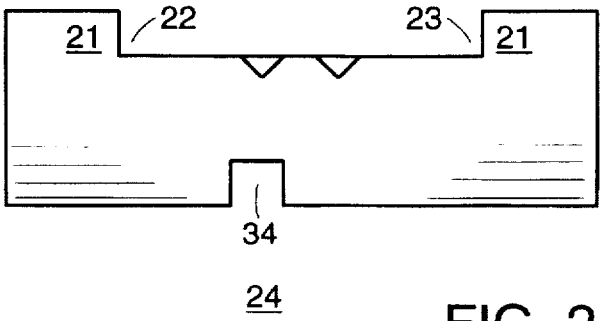
FIG. 2 depicts a sliding safety button which might be used with the present invention.

FIG. 2 depicts a side-view of a sliding safety button 24, which is located within slot tube 14. Each slot tube 14 through 17 has a corresponding sliding safety button, safety button 24 through 27, respectively. These additional safety buttons 25 through 27 are not depicted in FIG. 2 to facilitate the viewer's image. Sliding safety button 24 has raised stop ends 21 and key way slot 34. Stop ends 21 has a purpose of stopping the longitudinal translation of sliding safety button 24 by abutment of interior side 22 or 23 against an obstruction, thus maintaining at least a portion of sliding safety button 24 within a portion of a slot tube 14. Each safety button 24 through 27 has a corresponding equivalent interior side 22 or 23. Key way slot 34 is offset from center; but the exact location is dependent upon the lock sequence strategy established for the particular device. Sliding safety button 24 can be manipulated, such as by the push from a finger, to translate within slot tube 14 to one or more positions.

Figure 3:
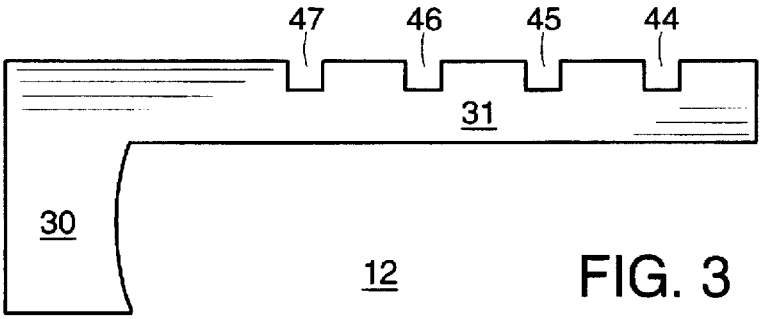
FIG. 3 depicts a slide trigger with activator rod used in the present invention.

FIG. 3 is a side-view of the slide trigger 12 having trigger body 30, activator rod 31 and a plurality of slots, being slots 44, 45, 46, and 47. Trigger body 30 and activator rod 31 are adjoined by monolithic construction means in this depiction, but in other embodiments a trigger body and an activator rod could be separate elements joined by known joining means, such as by welding or bolting. In still other embodiments using a double action trigger system, an activator rod could be joined to a moveable element of the trigger system such that "freezing" or fixing of the activator rod would prevent use of the trigger to engage or operate the firing action of the particular weapon. For example, in a Smith & Wesson Model 59 Double Action pistol, an activator rod would join the trigger at a point above or below the trigger insert pin so that an immovable activator rod would prevent trigger rotation about the trigger insert pin.

Figure 4:
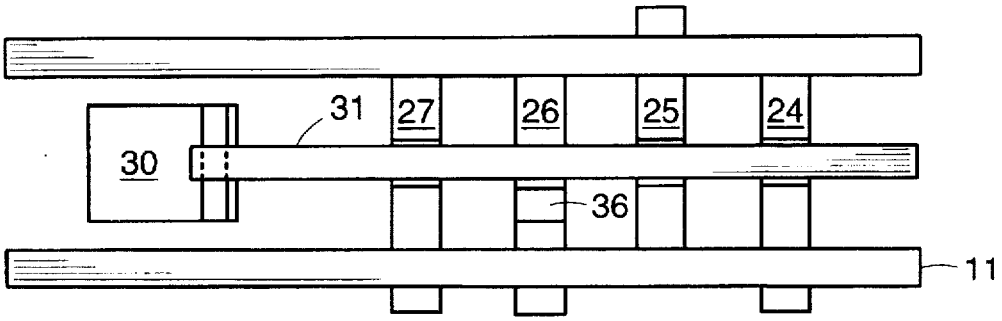
FIGS. 4 and 5 depict cross-sectional views of the handgun frame of FIG. 1 with sliding safety buttons of FIG. 2 type and a trigger of FIG. 3 type.

FIG. 4 depicts a cross-sectional bottom-view of handgun frame 10 and having therein trigger 12 (number absent) with trigger body 30 and activator rod 31 together with sliding safety buttons 24, 25, 26, and 27. Key way slot 36 of sliding safety button 26 is exposed, indicative of sliding safety button 26 being in a position transecting activator rod 31 through slot 46 to obstruct translation of activator rod 31.

Figure 5:
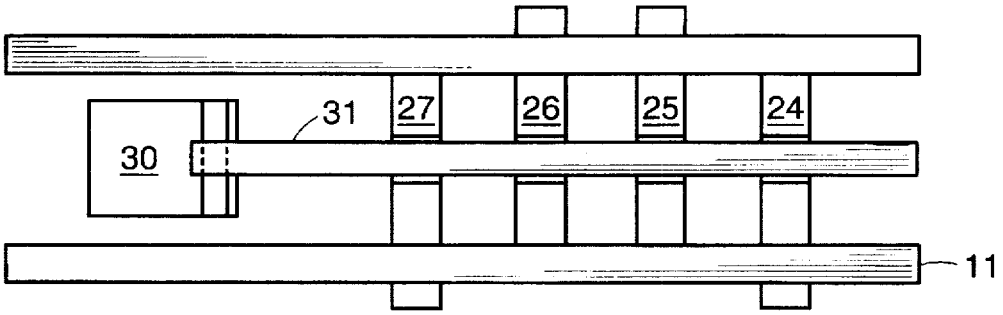

FIG. 5 is a second cross-sectional bottom-view of the handgun frame 10 previously shown in FIG. 4. However, in FIG. 5, sliding safety button 26 has been moved such that key way slot 36 of sliding safety button 26 previously shown in FIG. 4 is now in alignment with activator rod 31 thereby permitting the translation of activator rod 31 and trigger body 30 so that pulling on trigger 30 will fire the gun of which it is a part.

Figure 6:
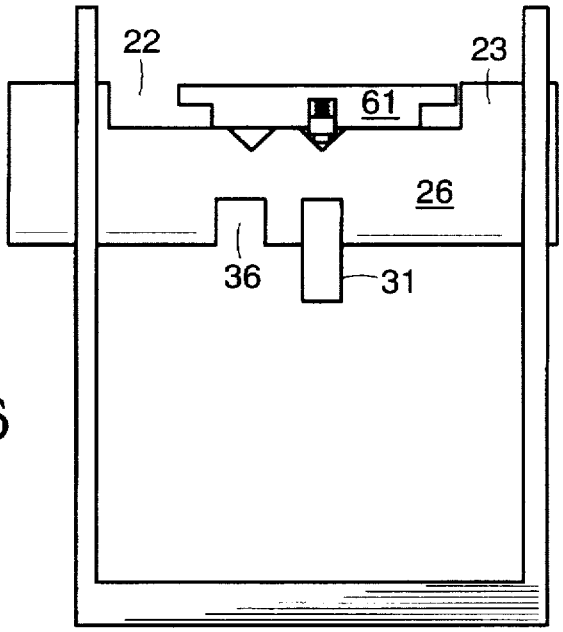
FIG. 6 is an end view of a portion of the Frame of FIGS. 4 and 5.

FIG. 6 depicts a cross-sectional front end view of the upper portion of handgun frame 10 contained therein sliding safety button 26 and showing interior side 22 and obstructive structure 61 which acts to prevent the total translation of sliding safety button 26 out of the not shown slot tube 16. The position of sliding safety button 26 is the same as that which was depicted in FIG. 4 such that activator rod 31 is not aligned in slot 36. Obstructive structure 61 is preferably a flat retaining bar which not only prevents the safety buttons from sliding out of the slot tubes, but prevents the safety buttons from rotating. Obstructive structure 61 also preferably has dimples on the side facing the safety buttons that engage in shallow depressions in the safety buttons to retain the safety button in the "on" or "off" position. If desired, spring-loaded mechanisms can be employed to bias the obstructive structures more securely in the shallow depressions.

Removal of obstructive structure 61 allows the removal and reversal of the sliding safety buttons such that the combination of the buttons can be changed.

In a further embodiment, the present invention is a firearm safety lock system for a weapon having a trigger, which lock system comprises an engagement portion moveable to a position in which the engagement portion can be operatively locked to prevent movement of the trigger; two or more members operatively optionally moveable to a locked position configuration which locks movement of the engagement portion or to an unlocked configuration which permits movement of the engagement portion. Preferably the engagement portion and the lock members are relatively shaped to form an open key way when the lock members are in an unlocked configuration.

While the above description of the present invention illustrated use in a firearm, such a trigger safety device can be used in other apparatus as well. For instance, many tools and machines have trigger mechanisms to which the present invention can be adapted for use. An example is the trigger used to operate the spray arm in a pressured spray tank, such as in painting or agrichemical applications.

The foregoing description is not intended as a limitation on the scope of the invention and variations may be made within the spirit thereof.

What is claimed is:

1. A safety lock device for a firearm trigger comprising an engagement portion movable to a position in which the engagement portion can be operatively locked to prevent movement of the trigger and block a firing mechanism; the safety lock consisting of lock members operatively movable to a locked configuration which locks movement of the engagement portion; the engagement portion monolithically connected to and operatively linked to the trigger of the firing mechanism; the engagement portion consisting of a sliding member with a notch and an open keyway; the lock members comprising sliding buttons that can be set to "on" or "off" settings for the locked and unlocked positions; each sliding button being notched perpendicular to its long axis and movable into a slot tube that is perpendicular to the engagement portion; and the engagement portion being notched perpendicular to its long axis such that when the sliding buttons are longitudinally moved to a position where the notches in the sliding buttons create an open keyway the engagement portion may move to allow operation of the trigger.

2. The safety lock of claim 1 wherein the locked and unlocked position can be reversed by removing the sliding buttons from their respective slot tube and reinserting them into the tube in the opposite direction of their previous orientation.

* * * * *